US007104482B2

(12) United States Patent
Juhlin

(10) Patent No.: US 7,104,482 B2
(45) Date of Patent: Sep. 12, 2006

(54) CLUTCH FOR ROCK CRUSHER

(75) Inventor: Jon Juhlin, Pleasant Hill, OR (US)

(73) Assignee: Johnson Crushers International, Eugene, OR (US)

( * ) Notice: Subject to any disclaimer, the term of this patent is extended or adjusted under 35 U.S.C. 154(b) by 103 days.

(21) Appl. No.: 10/989,985

(22) Filed: Nov. 15, 2004

(65) Prior Publication Data

US 2006/0102760 A1 May 18, 2006

(51) Int. Cl.
*B02C 2/00* (2006.01)

(52) U.S. Cl. ..... 241/207; 192/25; 192/41 S; 241/101.2

(58) Field of Classification Search ..... 192/41 R, 192/41 S, 25; 241/201–207, 101.2
See application file for complete search history.

(56) References Cited

U.S. PATENT DOCUMENTS 3,207,449 A 9/1965 Johnson
4,919,645 A * 4/1990 Sakakibara et al. ..... 474/245
5,131,485 A * 7/1992 Io et al. ..... 180/445

* cited by examiner

*Primary Examiner*—Mark Rosenbaum
(74) *Attorney, Agent, or Firm*—Schwabe, Williamson & Wyatt

(57) ABSTRACT

A substantially unidirectional clutch for rock crushers that may help prevent undesired rotation of the cone.

21 Claims, 4 Drawing Sheets

CLUTCH FOR ROCK CRUSHER

FIELD OF THE INVENTION

Embodiments of the present invention relate to, but are not limited to, clutch devices, and in particular, to the field of clutch devices for rock crushers.

BACKGROUND

Rock crushers such as cone crushers are generally used for crushing large rocks into smaller rocks or gravel. These machines typically include, among other components, a stationary inverted conical- or bowl-shaped bowl that is coupled to a bowl liner and a cone assembly that is disposed within the bowl liner and is typically gyrated within the bowl liner during rock crushing operations. The bowl liner includes an opening at the top of the bowl where, for example, rocks may pass. The gyrating motion of the cone assembly results from the rotational motion of an eccentric, which rotates about a center axis. This center axis also generally defines the center axis of the rock crusher machine. The cone assembly will typically be defined by its own center axis, for purposes of this description to be called a "cone axis," which is offset from the center axis of the rock crusher.

As described above, during a typical rock-crushing operation, the cone assembly moves in a gyrating motion within the interior space of the bowl liner. During operation, the cone axis of the cone assembly will rotate around the center axis of the rock crusher machine (e.g., the center axis of the cone assembly will be offset from center axis of the rock crusher) in a gyrating motion. The gyratory motion of the cone assembly may be imparted via an eccentric that rotates with respect to a stationary or movable shaft. In either case, a frame supports the shaft and cone assembly, and a drive shaft or other driving mechanism is utilized to drive the eccentric assembly. When the rock crusher is operating normally and crushing rocks, the cone assembly rotates in a direction opposite to the eccentric direction of rotation due to the countervailing forces of the material (e.g., rocks) being crushed.

The eccentric typically rotates at a high rate of speed, in some cases, at speeds greater than or equal to about 200 rotations per minutes (rpm). Although the interface between the eccentric and the cone assembly is lubricated and generally includes bearings and/or bushings disposed between the two components, without counteracting forces preventing movement, the cone assembly will tend to rotate along with the eccentric. For example, during no-load operations when the eccentric is rotating but no material is being crushed, the cone assembly along with the cone shaft tends to accelerate in the direction of the eccentric. Eventually, if no material is dropped into the crusher and the cone assembly is allowed to rotate freely with the eccentric, the tendency is for the cone assembly to spin at the same high rate of speed as the eccentric. Such rotation is generally undesirable because if rocks are suddenly introduced into the crusher, certain crusher components could be damaged. These components include, for example, the mantle that covers the cone assembly and the bearings that are disposed between the eccentric and the cone assembly. The abrupt introduction of rocks onto the fast moving mantle can result in friction damage to the mantle. The sudden deceleration and reversal of direction of rotation of the cone may cause bearing elements to skid on adjacent surfaces if the lubrication film is momentarily disrupted. Such skidding action may cause premature wear and/or permanent damage to the bearing element(s) and/or bushings.

Further, under certain circumstances, the cone assembly may be subjected to torque(s) in the direction of eccentric rotation that are significantly higher than those produced during normal no-load conditions. Such torque may be the result of uncrushable objects entering the crushing chamber and/or excessive internal friction within the crusher.

BRIEF DESCRIPTION OF THE DRAWINGS

Embodiments of the present invention will be readily understood by the following detailed description in conjunction with the accompanying drawings. To facilitate this description, like reference numerals designate like structural elements. Embodiments of the invention are illustrated by way of example and not by way of limitation in the figures of the accompanying drawings.

DETAILED DESCRIPTION OF EMBODIMENTS OF THE INVENTION

In the following detailed description, reference is made to the accompanying drawings which form a part hereof wherein like numerals designate like parts throughout, and in which is shown by way of illustration embodiments in which the invention may be practiced. It is to be understood that other embodiments may be utilized and structural or logical changes may be made without departing from the scope of the present invention. Therefore, the following detailed description is not to be taken in a limiting sense, and the scope of embodiments in accordance with the present invention is defined by the appended claims and their equivalents.

The following description includes terms such as on, onto, under, between, underlying, shallow, deep, and the like, that are used for descriptive purposes only and are not to be construed as limiting. That is, these terms are terms that are relative only to a point of reference and are not meant to be interpreted as limitations but are instead, included in the following description to facilitate understanding of the various aspects of the invention.

According to various embodiments of the invention, a substantially unidirectional clutch that may be employed in a rock crusher machine is provided. For the embodiments, the clutch may be coupled to a cone brake shaft (herein "cone brake shaft") of the rock crusher machine. In various embodiments, the clutch may include a first block and a second block having features that allow the first block to rotate in one rotational direction relative to the second block but does not allow the first block to substantially rotate in the opposite rotational direction. In some embodiments, the clutch may be coupled to a torque limiting device and/or shear bolts in order, for example, to prevent excessive torque from being applied to the clutch. The following description provides a unidirectional clutch in accordance with some embodiments employed in a specific type of a rock or cone crusher. However, embodiments of the present invention may be used with different types of rock or cone crushers having a variety of designs and configurations.

Figure 1:
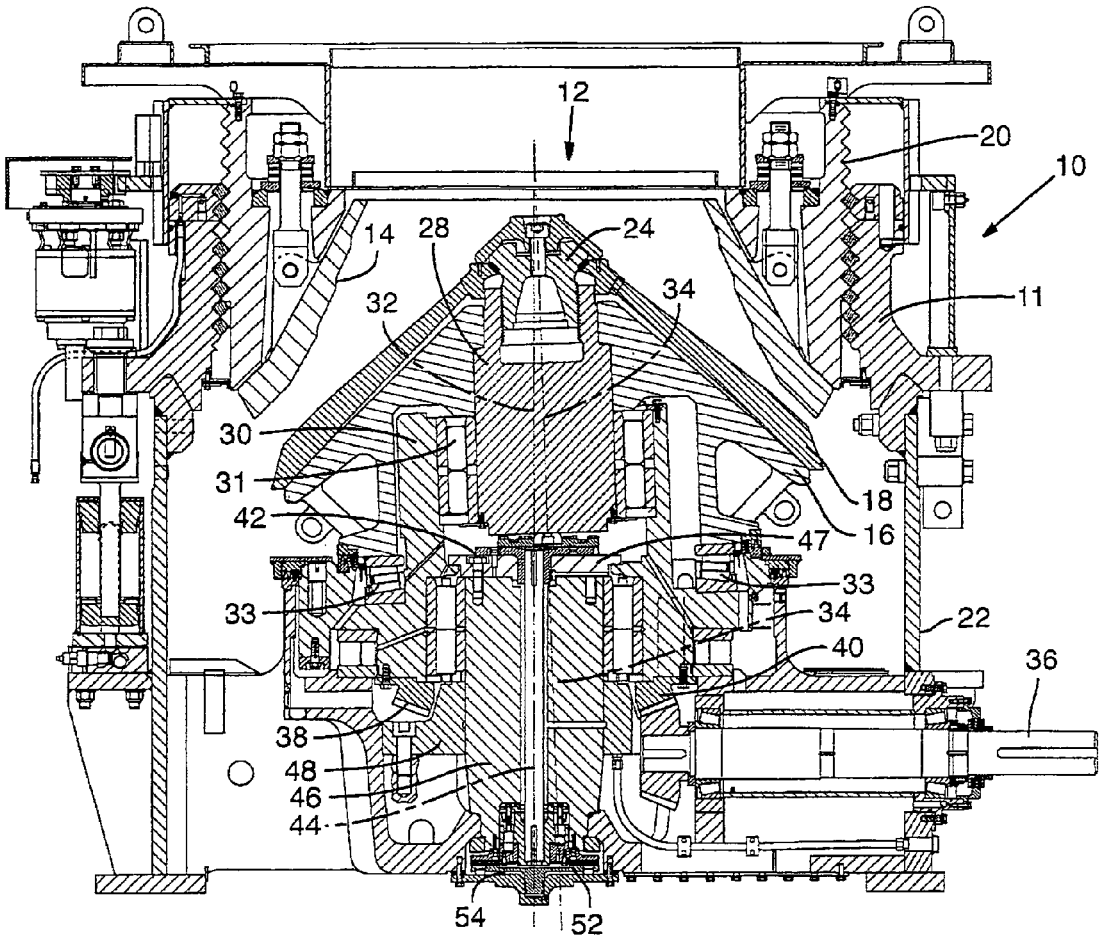
FIG. 1 illustrates a rock crusher with a substantially unidirectional clutch in accordance with some embodiments.

FIG. 1 depicts a rock crusher that includes a substantially unidirectional clutch in accordance with some embodiments of the invention. The rock crusher (herein "crusher") 10 may be a cone crusher with a conically shaped entry or opening 12 through a replaceable bowl liner 14. A crushing cone (herein cone) 16 may have a mantle 18 that may be movably mounted strategic to the bowl liner 14. The cone 16 and/or the mantle 18 may be referred as a cone assembly. In other embodiments, however, the cone assembly may include fewer or more components.

The cone 16, in various embodiments, may be gyrated around the interior space of the bowl liner 14 in order to crush the materials (e.g., rocks) that may be dropped through the opening 12 and against the bowl liner 14. During rock crushing operations, the bowl liner 14 generally remains stationary relative to the cone 16. In order to make the bowl liner 14 stationary, it may be secured to a bowl 20, which may be, for example, threadably secured to a bowl support 11. The bowl support 11, in turn, may be coupled to a base frame 22.

As described above, the mantle 18 may be coupled to the top of the cone 16. The mantle 18, which may be replaced periodically after being worn down by repetitive rock-crushing operations, may be coupled to the underlying cone 16 with a mantle nut 24. The cone 16 may include a cone stem 28. The cone stem 28, in various other embodiments, may be integral with the cone 16. In some embodiments, the cone stem 28 may be an interference fit with the bore in the machined cone casting or may be part of the casting itself. Once assembled, the cone stem 28 and the cone 16 may effectively be a single operational component.

The gyrating motion of the cone 16 may be produced in part by a rotating motion of an eccentric 30, including but not limited to a wedge plate eccentric, and may be coupled to the cone 16 via bearings 31 and thrust bearing 33. The rotational motion of the eccentric 30 (relative to its own central axis 32) may be translated to the gyrating motion of the cone 16 via the bearings 31 and thrust bearings 33.

In various embodiments, the eccentric 30 may rotate about a central axis 32 (e.g., the center axis of the crusher 10), and the rotation of the cone 16 about cone axis 34 may be offset from the central axis 32. During rock crushing operations, the gyrating motion of the cone 16 will result from the cone axis 34 rotating around the central axis 32. Because of the gyrating motion of the cone 16, at any given moment, one side of the cone 16 may generally be closer to the bowl liner 14 than the opposite side of the cone 16 as depicted in FIG. 1 (e.g., in this illustration, the right side of the cone 16 is closer to the bowl liner 14 than the left side of the cone 16).

The eccentric 30, in various embodiments, may be driven by a pinion, a drive shaft 36 and/or other driving mechanisms. The spinning or rotational motion of the drive shaft 36 may be conveyed to the eccentric 30 via the bevel teeth 38 of a bevel gear 40 that are secured to the bottom of the eccentric 30. The drive shaft 36, in turn, may be coupled to a motor such as an electric motor or a combustion engine.

The cone stem 28 may be operationally coupled to a cone brake shaft 44 via a coupling assembly 42. The coupling assembly 42 may include, for example, a torque bar fixed to the bottom of the cone stem 28, a brake bar or brake plate that is attached to the top end of a cone brake shaft 44 and a floating plate that connects the two by means of two perpendicular grooves in the top and bottom surfaces. Note that although a specific type of coupling assembly 42 is depicted here, other types of coupling devices may be employed in other embodiments.

When the cone 16 is assembled with the eccentric 30, the rotation of the cone stem 28 about the cone axis 34 is translated into rotation of the cone brake shaft 44 about the main center axis 32 of the crusher 10. As a result, the rotational motion of the cone 16 relative to the cone axis 34 may be imparted to the cone brake shaft 44.

The cone brake shaft 44, in various embodiments, may be disposed within the base frame spindle 46, which may be coupled to a center section 48, and in other embodiments where the base frame do not have a separate center section, the spindle may be attached directly to the base frame. Disposed between the coupling assembly 42 and the base frame spindle 46 may be a thrust plate 47.

In various embodiments, the cone brake shaft 44 is coupled to a substantially unidirectional clutch 52 that may also be coupled to a torque limiting clutch or brake 54, components of which will be described in greater detail below. The substantially unidirectional clutch 52 may alternatively be coupled directly to the base frame spindle 46 or otherwise coupled directly to base frame 22. The torque-limiting clutch or brake 54 may or may not include devices, such as a friction disc, that may limit the amount of torque that the cone shaft 44 may transfer to the substantially unidirectional clutch 52. For the embodiments, the substantially unidirectional clutch 52 allows the cone 16 to rotate in one direction (relative to its own cone axis 34) but may prevent the cone 16 from substantially rotating in the opposite direction. In some embodiments, this may prevent the damaging of certain crusher components during, for example, no-load conditions when the eccentric is rotating but no material is in the crushing chamber (e.g., between the mantle 18 and the bowl liner 14).

Note that in other embodiments, other means of coupling the cone stem 28 to the unidirectional clutch 52 may be used. That is, it is not absolutely necessary to mount the unidirectional clutch 52 to the bottom of the base frame spindle 46 as shown. For instance, the unidirectional clutch 52 could be mounted in the top of the base frame spindle 46 and eliminate the cone brake shaft 44 altogether. In still other embodiments, the unidirectional clutch 52 may even be adapted for installation in the cone head on certain crusher designs. Thus, in various embodiments, the unidirectional clutch 52 may be positioned in various locations in the crusher 10 and operationally coupled to the cone 16 (or the cone assembly) in such a way so that it may control the rotation of the cone 16 (or the cone assembly) about its cone axis 34.

Figure 2A:
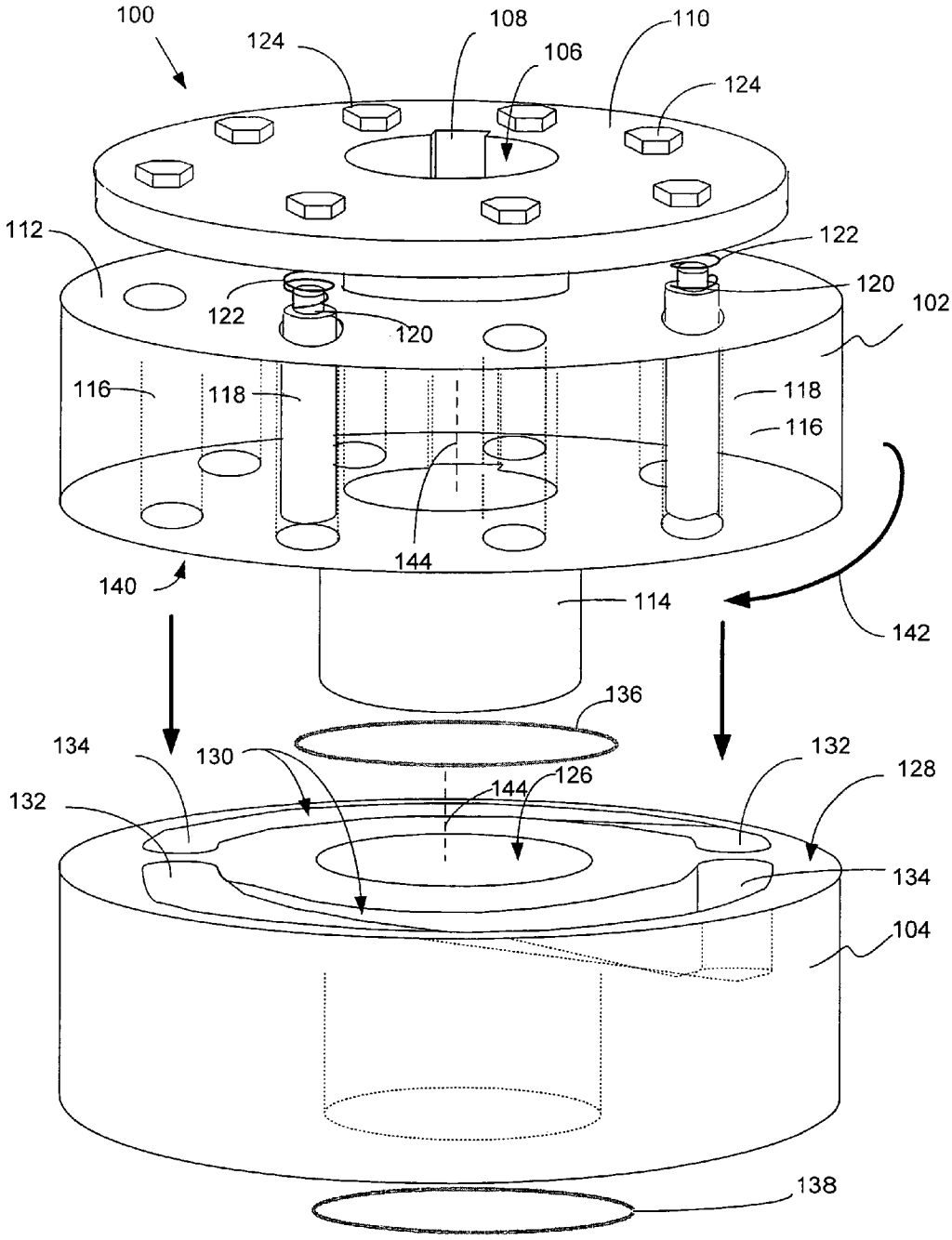
FIG. 2A illustrates a perspective view of a substantially unidirectional clutch in accordance with some embodiments.
Figure 2B:
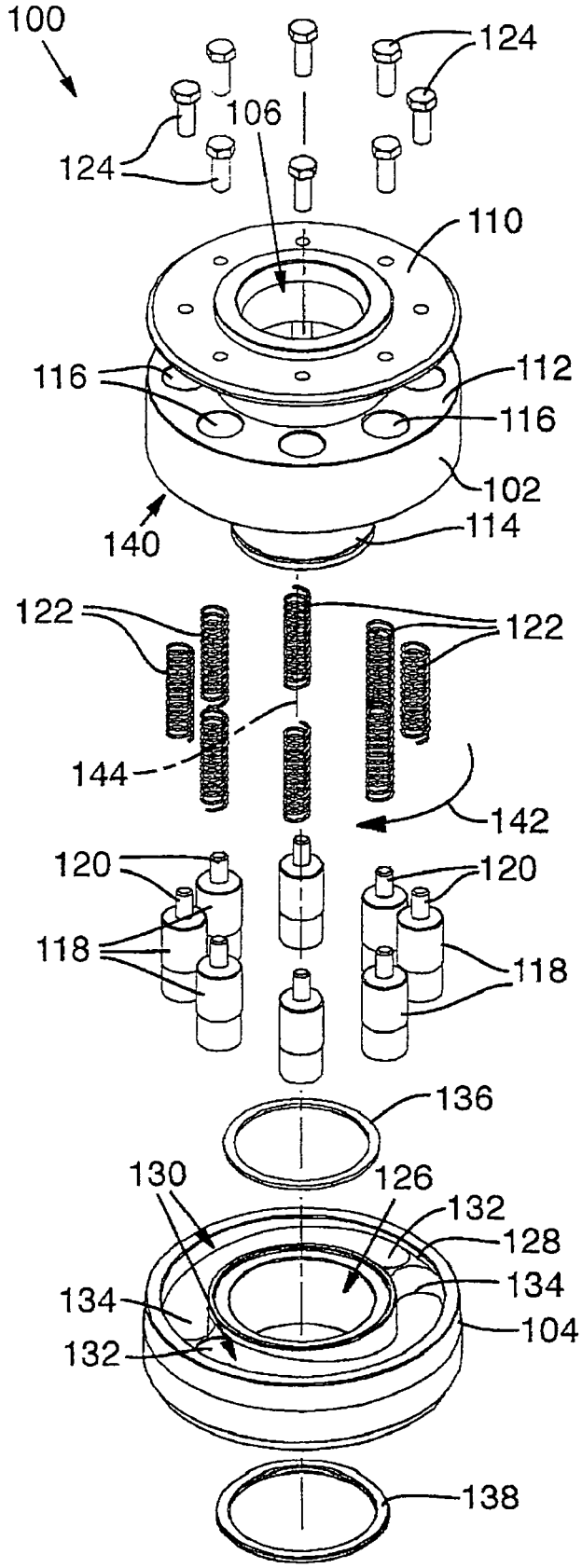
FIG. 2B illustrates an exploded view of a substantially unidirectional clutch in accordance with some embodiments.

FIG. 2A depicts a perspective view of a substantially unidirectional clutch in accordance with some embodiments of the invention. For these embodiments, the clutch 100 includes a first block 102 and a second block 104. The first block 102, which may be referred to as the drive block, may be adapted to operationally couple with the cone 16 of a crusher 10. In some embodiments, the first block 102 may include an aperture 106 for receiving a cone brake shaft 44. The aperture 106 may be a splined or keyed aperture as indicated by ref. 108. In addition to the aperture 106, the first block 102 may include a retainer plate 110 coupled to a main body 112 of the first block 102 and an extension 114 that is disposed on the opposite side of the main body 112 from the retainer plate 110. The aperture 106 may penetrate through the retainer plate 110, the main body 112 and the extension 114. In various embodiments, each of the retainer plate 110, the main body 112 and the extension 114 may have cylindrical shapes. In order to provide another perspective of the clutch 100, an exploded view of the clutch 100 of FIG. 2A is depicted in FIG. 2B.

In some embodiments, the first block 102 may include multiple holes 116 that penetrate completely through the main body 112 of the first block 102 from one side (surface) of the main body 112 to the other side (surface) of the main body 112. Note however that in other embodiments, less than or greater than eight holes 116 may be included in the main body 112. Disposed within one or more of the holes 116 may be pins 118. The pins 118 may include pin extensions 120 on the retainer plate side of the pins 118. Coupled to the pins 118 are force exerting components that exert force to the pins 118 urging the pins 118 away from the retainer plate 110 and towards the second block 104. For these embodiments, the force exerting components are coil springs 122 that wrap around the pin extensions 120. The coil springs 122 may be guided and/or held in place by bolts or screws 124 that are inserted through the retainer plate 110. In other embodiments, other force exerting components may be employed.

The second block 104 may include an aperture 126 for receiving the extension 114 of the first block 102. In various embodiments, the second block 104 may or may not be further coupled to a torque-limiting device such as a friction disc. The second block 104 may have a cylindrical shape that may correspond to the shape of the first block 102. The top surface 128 of the second block 104 may include two helical ramp grooves 130 and thrust washer 136. In other embodiments, however, the top surface 128 may include more or less than two helical ramp grooves 130. The helical ramp grooves 130 may be characterized by first and second ends 132 and 134 and may be sized and located along the top surface 128 to receive at least a portion of the pins 118 of the first block 102. That is, the helical ramp grooves 130 may have sufficient widths to at least accommodate the widths of the pins 118. Further, the helical ramp grooves 130 may be radially located on the top surface 128 of the second block 104 so that when the first and second blocks 102 and 104 are operationally coupled, the helical ramp grooves 130 may align with at least portions of the pins 118. The first ends 132 are the shallow ends of the helical ramp grooves 130 while the second ends 134 are the deep ends of the helical ramp grooves 130. The second ends 134 may be characterized by walls that are substantially perpendicular to the top surface 128 of the second block 104.

The second block 104 may be anchored to the torque limiting clutch or brake 54 or some other base of the crusher 10. This may be accomplished by a mechanical connection such as bolts, splines, keys, and the like, with or without a torque-limiting device. Typically the fasteners and/or shear pins that may, be used in this connection are sized such that they may shear before enough torque is generated to damage other more expensive components.

Disposed between the first and second blocks 102 and 104 may be a thrust washer 136 that may be part of the top surface 128 of the second block 104. Note that when the first and second blocks 102 and 104 are operationally coupled, the first block 102 may actually sit on top of the thrust washer 136 rather than be in direct contact with the second block 104. The thrust washer 136 may fit around the extension 114 of the first block 102. The thrust washer 136 may be included in various embodiments in order to, for example, extend the life of the clutch 100. Similarly, on the underside of the second block 104 may be a retainer ring 138, which may hold the clutch assembly (e.g., blocks 102 and 104) together during installation and which may further resist any tendency for the first and second blocks 102 and 104 to separate due to forces generated by the pin coil springs 122 or frictional resistance of the pins 118 in their bores 116 as the pins 118 are urged upward as they move up the helical ramp grooves 130.

In various embodiments, the first block 102 and the second block 104 may be operationally coupled by directly or indirectly mating and/or otherwise operationally coupling the first surface (bottom surface) 140 of the first block 102 with the second surface (top surface) 128 of the second block 104. As described previously, the second or top surface 128 of the second block 104 may include a thrust washer 136 or some other component that may be machined into the second block 104 that serve similar such purposes. The coupling of the first and second surfaces 140 and 128 may be facilitated by insertion of the extension 114 of the first block 102 into the aperture 126 of the second block 104. Both the first and second blocks 102 and 104 may be defined by a center axis 144 that is perpendicular to the first and second surfaces 140 and 128. As described above, the helical ramp grooves 130 on the second surface 128 may be radially located from the center axis 144 such that the holes 116 (as well as the pins 118) are aligned on top of at least a portion of the helical ramp grooves 130. In particular, the helical ramp grooves 130 and the holes 116 may be located along a first and second radii that are substantially equal.

When the substantially unidirectional clutch 100 is employed in a rock crusher such as a cone crusher, the first block 102 may be allowed to rotate, relative to the second block 104, in one rotational direction (in this illustration, in a clockwise direction as indicated by ref. 142) but may be prevented from rotating substantially in the opposite direction. In particular, when the first and second blocks 102 and 104 are coupled, the pins 118 may be urged towards the bottom surface of the helical ramp grooves 130. For the illustration depicted in FIG. 2A, as the first block 102 is rotated in a clockwise rotation as indicated by ref. 142, the pins 118 move along the helical ramp grooves 130 moving from, for example, the deep second ends 134 to the shallow first ends 132 of the helical ramp grooves 130.

However, if the first block 102 is made to rotate in the opposite counterclockwise direction, the first block 102 is substantially prevented from rotating in such a direction. This is because the deep second ends 134 of the helical ramp grooves 130 includes walls that are substantially vertical relative to the second surface 128 of the second block 104 and the pins 116 are prevented by these vertical walls from rotating substantially in the counterclockwise direction. Note that for these embodiments, the first block 102 may rotate some distance in the counterclockwise direction before the pins 116 are stopped by the vertical walls of the deep ends 132. As a result, the clutch 100 is not a zero backlash mechanism since the first block 102 may rotate, to a certain degree, in the direction opposite of the allowed rotational direction (i.e., for the above illustration in the clockwise direction is the allowed rotational direction). Therefore, the first block 102 is only substantially prevented from rotating in the counterclockwise direction. Clearly, the more pins 116 and/or helical ramp grooves 130 there are, the lesser amount of back rotation.

In various embodiments, the pins 118 may be made of a material having characteristics to withstand the shearing forces encountered when the first block 102 is urged into a reverse rotation (e.g., counterclockwise in the illustrated embodiments above). In various embodiments, the pins 118 may be made of a high strength metal or alloy.

Note that the unidirectional clutch 100 of FIGS. 2A and 2B may be employed with various types and/or designs of rock crushers other than the one depicted in FIG. 1. Further, in some embodiments and as previously described, the unidirectional clutch 100 may be located in other locations in the rock crusher other than at the base of the crusher (as depicted in FIG. 1) and/or coupled to other components other than those depicted in FIG. 1.

Figure 3:
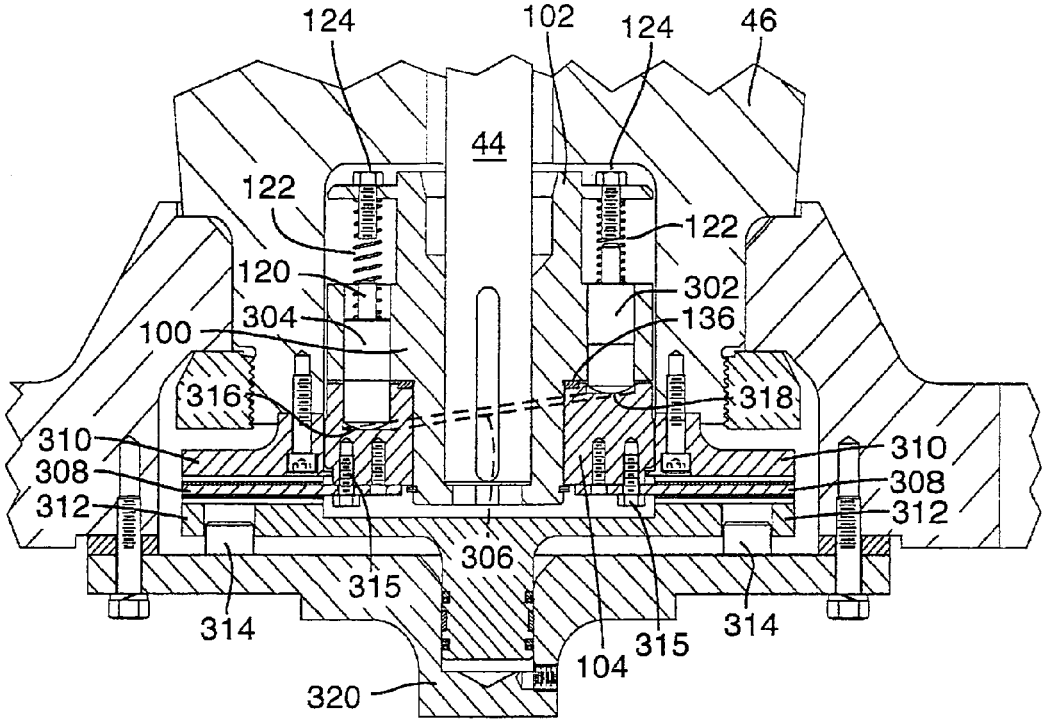
FIG. 3 illustrates the substantially unidirectional clutch of FIG. 1, in further detail, in accordance with some embodiments.

FIG. 3 depicts a cross-sectional view of the substantially unidirectional clutch of FIGS. 2A and 2B disposed in a cone crusher in accordance with some embodiments of the present invention. The clutch 100 may be disposed within a base frame spindle 46. The clutch 100 includes a first block 102 and a second block 104. Inserted into the first block 102 is a cone brake shaft 44. In various embodiments, the cone brake shaft 44 may be operationally coupled to the cone 16 of a cone crusher 10. The second block 104 may be coupled to the base frame of the cone crusher. The base frame may include, among other components, base frame spindle 46, friction disc 308, pressure plates 310 and 312, assorted pins and bolts including pins 314, hydraulic cylinder 320 and the like.

The second block 104 may be coupled to the base frame via a friction disc 308. In particular, the second block 104 may be bolted to the friction disc by shear bolts 315. The friction disc 308 may be clamped between two pressure plates 310 and 312. The upper pressure plate 310 may be fixed to the bottom of the cone crusher while the lower pressure plate 312 may be pressed vertically by hydraulic pressure to clamp the friction disc 308 between the two pressure plates 310 and 312. The lower pressure plate 312 may be prevented from rotating by pins 314 that are attached to the hydraulic cylinder 320, which may be fixed to the bottom of the cone crusher. The pins 314 may prevent rotation because they protrude through holes provided in the lower pressure plate 312.

Any torque transmitted to the substantially unidirectional clutch 100 in the disallowed direction via the cone shaft 44 may be resisted by the clamped friction disc 308 up to its torque limit or until the shear bolts 315 shear off. The torque limit, in some embodiments, may be a function of friction coefficient and hydraulic force.

The shear bolts 315 may provide a fail safe "fuse" to protect other components in the event that the friction disc 308 does not slip at different torque levels depending on whether the load is applied slowly or suddenly. In some embodiments, the substantially unidirectional clutch 100 may be employed without being coupled to a torque-limiting friction clutch (e.g., friction disc 308) since the shear bolts 315 can prevent damage to related components by adjusting the number and/or size and/or material of the shear bolts 315.

As previously described, the clutch 100 includes a first and second blocks 102 and 104. For the embodiments, the first block 102 having a plurality of pins (although only two pins 302 and 304 are depicted in FIG. 3) and the second block 104 having a helical ramp groove 306. The helical ramp groove 306 includes a deep end 316 and a shallow end 318. In FIG. 3, pin 304 is depicted as extending into the deep end 316 of the helical ramp groove 306 while the other pin 302 is depicted as being on top of the shallow end 318 of the helical ramp groove 306. Downward forces are applied to both of the pins 302 and 304 by coil springs 122 to assure that the pins 302 and 304 maintains contact with the bottom surface of the helical ramp groove 306.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the embodiments of the present invention. Therefore, it is manifestly intended that this invention be limited only by the claims.

What is claimed is:

1. An apparatus, comprising a first block adapted to operationally couple with a rock crusher cone assembly, the first block comprising a first surface, the first surface having a first hole and a first pin disposed at least partially in the first hole, at least a first force exerting component acting on the first pin to exert a force on the first pin sufficient to urge the first pin away from the first hole; and a second block operationally coupled to the first block and having a second surface, the second block comprising a first helical ramp groove on the second surface, the first helical ramp groove radially oriented on the second surface to align at least a portion of the first helical ramp groove under the first hole on the first surface of the first block and sized to receive at least a portion of the first pin.

2. The apparatus of claim 1, wherein the first surface of the first block has a second hole and a second pin is disposed at least partially in the second hole, at least a second force exerting component acting on the second pin to exert a force on the second pin urging the second pin away from the second hole.

3. The apparatus of claim 2, wherein the second surface of the second block further comprises a second helical ramp groove, the second helical ramp groove is radially oriented on the second surface to align at least a portion of the second helical ramp groove under the second hole on the first surface of the first block and sized to receive at least a portion of the second pin.

4. The apparatus of claim 3, wherein the first surface of the first block including a first center axis perpendicular to the first surface, the first and second holes are disposed on the first surface along a first radius from the first center axis of the first surface.

5. The apparatus of claim 4, wherein the second surface of the second block including a second center axis perpendicular to the second surface, the first and second helical ramp grooves are disposed on the second surface along a second radius from the second central axis of the second surface, the second radius substantially equal to the first radius.

6. The apparatus of claim 5, wherein the first helical ramp groove having a first and second ends and the second helical ramp groove comprising of a third and fourth ends, the first and third ends having depths relative to the second surface greater than depths of the second and fourth ends, respectively.

7. The apparatus of claim 6, wherein the first and the third ends include walls oriented substantially perpendicular to the second surface of the second block.

8. The apparatus of claim 1, wherein the first block further includes an aperture on a third surface of the first block to adaptively receive a cone brake shaft, the third surface is located on the first block opposite the first surface.

9. The apparatus of claim 8, wherein the second block having an aperture on the second surface adapted to receive an extension of the first block, the extension is located on the first surface of the first block.

10. The apparatus of claim 1, wherein the second block is adapted to couple with a torque-limiting device.

11. The apparatus of claim 10, wherein the torque-limiting device includes a friction disc.

12. The apparatus of claim 1, wherein the first force exerting component is a coil spring.

13. The apparatus of claim 1, wherein the first helical ramp groove comprising of a first end and a second end, the first end has a depth relative to the second surface greater than depth of the second end.

14. The apparatus of claim 13, wherein the first end including a wall oriented substantially perpendicular to the second surface of the second block.

15. The apparatus of claim 1, wherein the second surface of the second block includes a thrust washer disposed thereon and the first block is operationally coupled to the second block via the thrust washer.

16. A rock crusher, comprising:

a cone assembly;

a first block coupled to the cone assembly, the first block comprising a first surface, the first surface having a first hole and a first pin disposed at least partially in the first hole, at least a first force exerting component acting on the first pin to exert a force on the first pin sufficient to urge the first pin away from the first hole; and a second block operationally coupled to the first block and having a second surface, the second block comprising a first helical ramp groove on the second surface, the first helical ramp groove is radially oriented on the second surface to align at least a portion of the first helical ramp groove under the first hole on the first surface of the first block and sized to receive at least a portion of the first pin.

17. The rock crusher of claim 16, wherein the cone assembly is coupled to the first block via a cone brake shaft.

18. The rock crusher of claim 17, wherein the cone brake shaft is coupled to the cone assembly via a coupling assembly.

19. The rock crusher of claim 16, wherein the second block is coupled to a torque-limiting device.

20. The rock crusher of claim 16, wherein the first helical ramp groove comprising of a first end and a second end, the first end has a depth relative to the second surface greater than depth of the second end.

21. The rock crusher of claim 20, wherein the first end comprising a wall oriented substantially perpendicular to the second surface of the second block.

* * * * *